United States Patent [19]

Greenhalgch

[11] Patent Number: 5,074,493

[45] Date of Patent: Dec. 24, 1991

[54] WING-EXTENDIBLE GLIDING STORE

[75] Inventor: Samuel Greenhalgch, Doylestown, Pa.

[73] Assignee: The United States of America as represented by the Secretary of the Navy, Washington, D.C.

[21] Appl. No.: 632,442

[22] Filed: Dec. 21, 1990

[51] Int. Cl.[5] ..... F41J 9/10

[52] U.S. Cl. ..... 244/3.27; 244/1 TD

[58] Field of Search ..... 244/3.29, 1 TD, 3.27, 244/3.1; 102/385, 386, 388; 273/360, 361

[56] References Cited

U.S. PATENT DOCUMENTS

| | | | |
|---|---|---|---|
| H.685 | 10/1989 | Olson et al. | 244/3.29 |
| 1,300,708 | 4/1919 | Edison | 244/3.29 |
| 1,324,433 | 12/1919 | Phillips | 102/385 |
| 1,448,166 | 3/1923 | Strong | 244/3.29 |
| 2,495,304 | 1/1950 | Wyckoff et al. | 102/385 |
| 3,188,957 | 6/1965 | Petre | 244/3.3 |
| 3,373,994 | 3/1968 | Woodward | 244/1 TD |
| 3,724,782 | 4/1973 | Gauzza et al. | 244/3.27 |
| 3,843,075 | 10/1974 | Weber et al. | 244/3.21 |
| 4,000,867 | 1/1977 | Daikeler et al. | 244/1 TD |
| 4,659,034 | 4/1987 | Diekmann | 244/1 TD |

FOREIGN PATENT DOCUMENTS

| | | | |
|---|---|---|---|
| 3119185 | 12/1982 | Fed. Rep. of Germany | 244/3.29 |

*Primary Examiner*—Michael J. Carone

*Attorney, Agent, or Firm*—James V. Tura; James B. Bechtel; Susan E. Verona

[57] ABSTRACT

The instant invention discloses a gliding store with spring-actuated, extendible wings. Upon launch from an aircraft, and separation from the aircraft a safe distance, a launch lanyard and wing control device is separated from the store, allowing a pair of hinged wings to be force open. Each wing is set on the store body at a predetermined position to cause the store to glide at a predetermined angle and with a predetermined flight path of free-fall.

6 Claims, 5 Drawing Sheets

FIG. 8
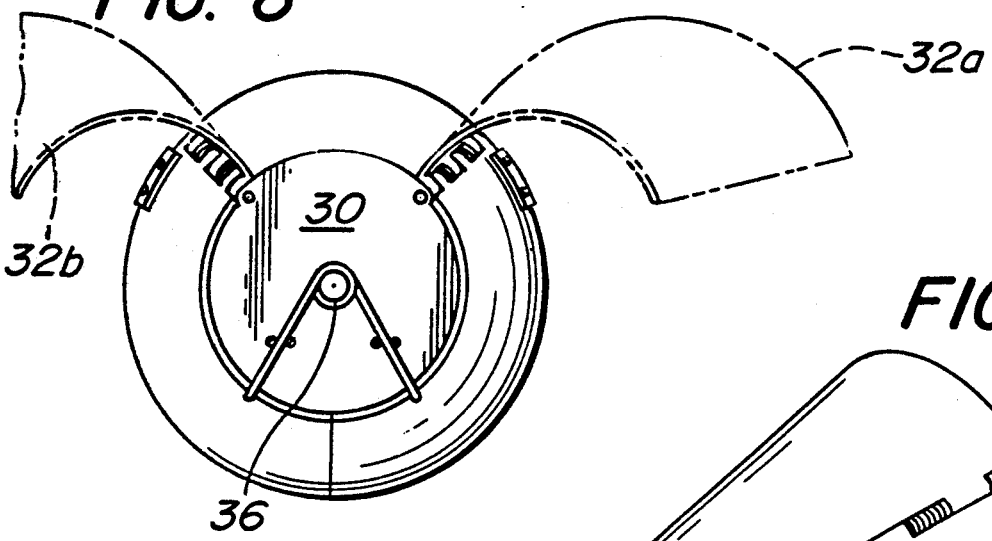
FIG. 9
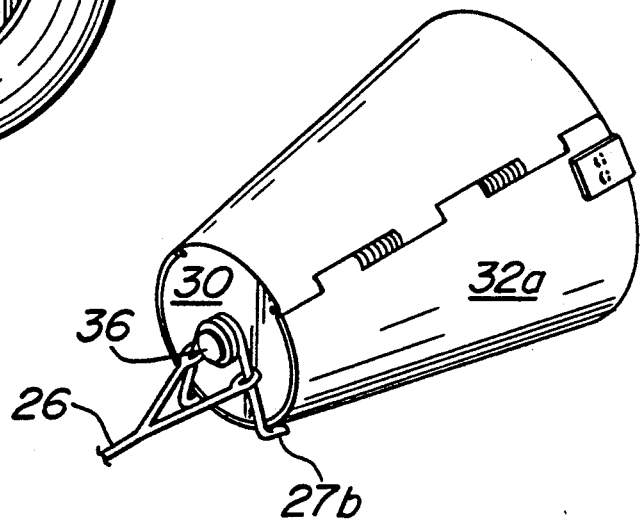
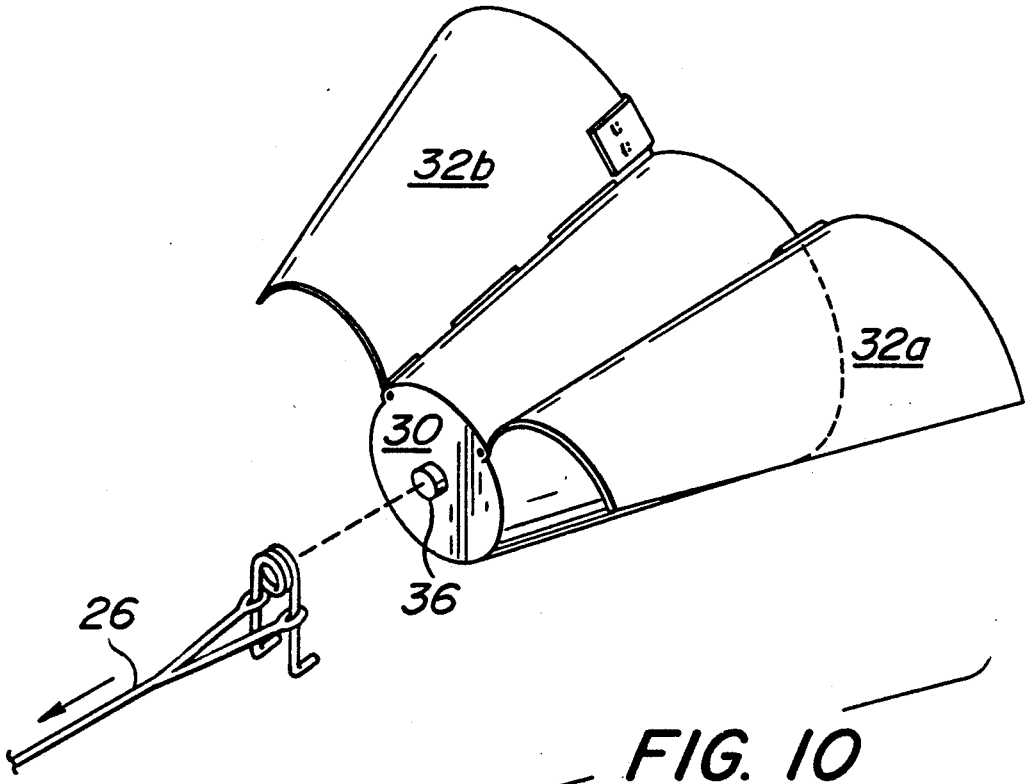
FIG. 10

WING-EXTENDIBLE GLIDING STORE

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention relates to objects that can be air-dropped from aircraft. In particular, this invention relates to gliding stores that are air-dropped from an aircraft and will glide to a predetermined location on the earth'surface.

BACKGROUND OF THE INVENTION

It is many times extremely valuable to release a multitude of objects, such as stores or sonobuoys, from an aircraft flying at a predetermined speed to cover a wide dispersal and geographical area. This problem is made more difficult by attempting to maintain all of the objects internal to the transporting aircraft. The low exit velocities of the objects cause them to merely fall beneath the aircraft in a relatively straight line. If parachutes are attached, they, too, will cause drift in nearly the same direction.

A flight control means for bombs is disclosed in U.S. Pat. No. 1,324,433, entitled "Flight-Control Means For Bombs", issued on Dec. 9, 1919 to G. T. Phillips, Jrs. This patent discloses means which continue to direct the flightpath of the bomb, once released from an aircraft, mainly in the vertical direction. Another invention, described in U.S. Pat. No. 2,584,826 entitled "Aerodynamic Surface For Dirigible Bombs", issued on Feb. 25, 1952 to R. D. Wyckoff, also shows that bombs may have lifting surfaces in the form of a prismatic shell. Neither of these two devices disclose how a store may achieve a predictable flight path, without using moveable control surfaces, once released from an aircraft.

SUMMARY OF THE INVENTION

It is therefore an object of the present invention to provide a wing-extendible gliding store that, when air-dropped from an aircraft, falls in a predictable flightpath to a prescribed destination.

It is a further object of the present invention to provide such a gliding store that does not require expensive components.

It is a still further object of the present invention to provide such a gliding store that is lightweight and relatively small so that a plurality thereof can be dispersed during a single pass of the dropping aircraft.

These and other objects of the invention are attained by providing a gliding store, in the shape of a truncated cone having a flattened front and back end and extendible wings. Each store is ejected from a launch container by means known in the art and has, at the forward and widest end, a launch lanyard and wing control device. After the store separates sufficiently from the aircraft, a line attached to the aircraft pulls the control device away and a pair of semi-conically shaped wings open. Each wing is hingedly attached at a predetermined part of the store body to open to non-symmetrical positions that causes the store to glide to the right or to the left. Latching means cause the wings to remain in their opened positions.

The novel features which are believed to be characteristics of the invention, both as to its organization and methods of operation, together with further objects and advantages thereof, will be better understood from the following descriptions in connection with the accompanying drawings in which the presently preferred embodiments of the inventions are illustrated by way of examples. It is to be expressly understood, however, that the drawings are for purposes of illustration and description only and are not intended as a definition of the limits of the invention.

BRIEF DESCRIPTION OF THE DRAWINGS

FIG. 8 gives an end view, as seen by looking at the front end, of the gliding store with the wings closed;

FIG. 9 gives a perspective view of the gliding store, as seen from the front, immediately after launch but before detachment of the wing release device; and FIG. 10 shows a view, similar to that of FIG. 9, except that it shows the detachment of the wing release device and the wings opened fully.

DETAILED DESCRIPTION OF THE PREFERRED EMBODIMENT

Figure 1:
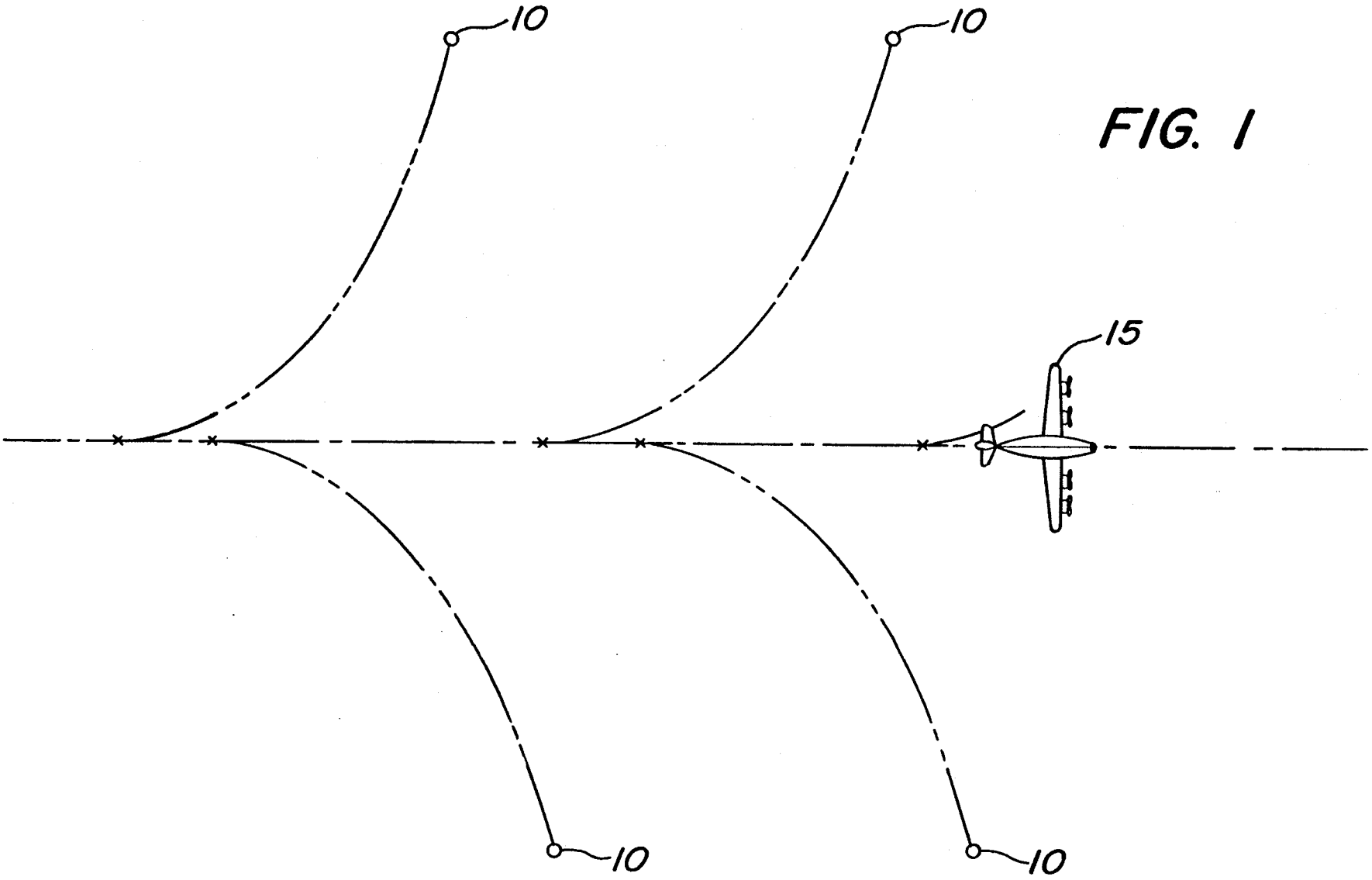
FIG. 1 shows a schematic representation of a potential dispersal pattern of gliding stores launched from an aircraft.
Figure 2:
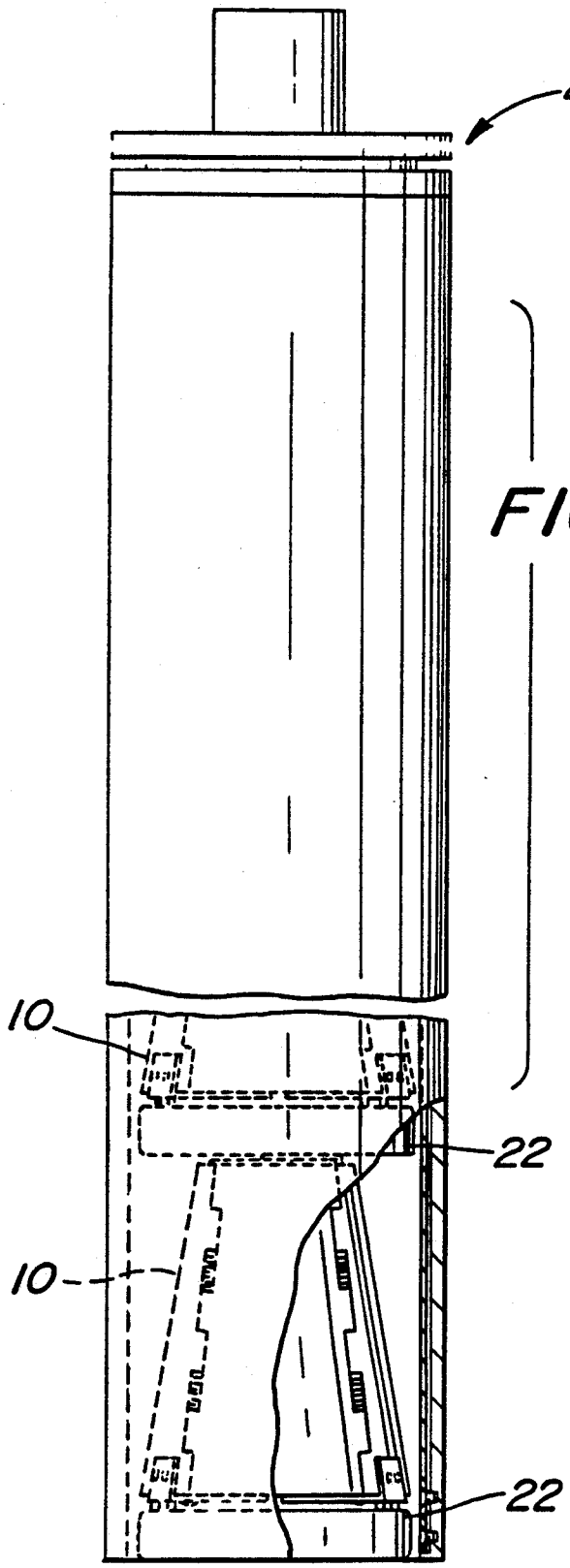
FIG. 2 gives a partially cut-away, longitudinal view of a standard launch container showing, in phantom, a plurality of gliding stores ready to be ejected.
Figure 7:
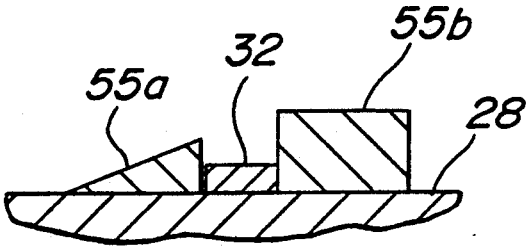
FIG. 7 shows a cross-sectional view of one of the wing latching means taken along lines V1—VI of FIG. 4.

Referring now to the drawings wherein like reference numberals designate like parts throughout the several views, the present invention, gliding stores, provides means to effectively and predictably obtain a lateral dispersion pattern, as shown schematically in FIG. 1, of said stores, flares, sonobuoys or other similar types of objects 10 launched from a single launcher 20 (as seen in FIG. 2) carried by a vehicle, such as an aircraft 15. FIG. 2 shows a longitudinal view, with portions cut away, of one type of launcher 20, which is similar to that described more fully in pending U.S. patent application Ser. No. 07/544,295, U.S. Pat. No. 5,052,270 assigned to the United States of America as represented by the Secretary of the Navy.

Figure 3:
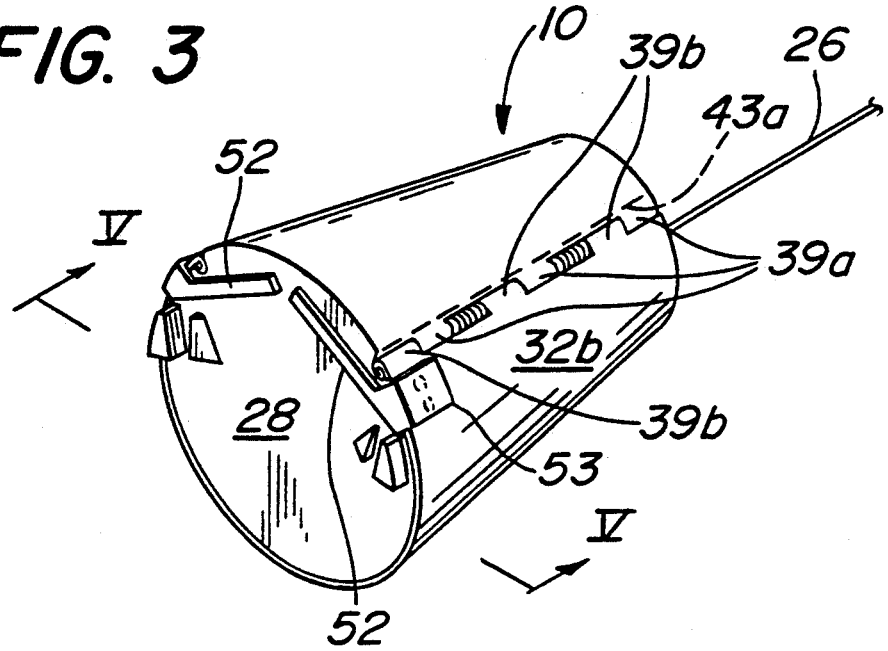
FIG. 3 gives a perspective view of one of the gliding stores, as seen from the rear, immediately after launch from the launch container but before detachment of the wing release device.
Figure 4:
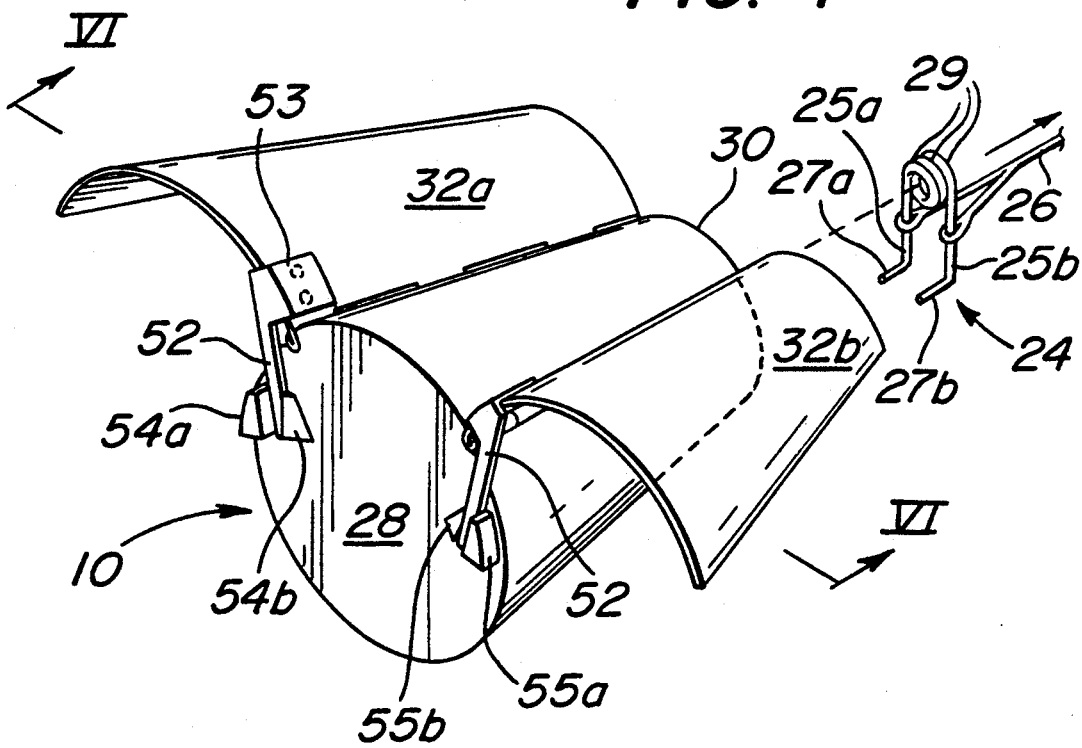
FIG. 4 gives a view, similar to that of FIG. 3, except that it shows the detachment of the wing release device and the wings opened fully.
Figure 5:
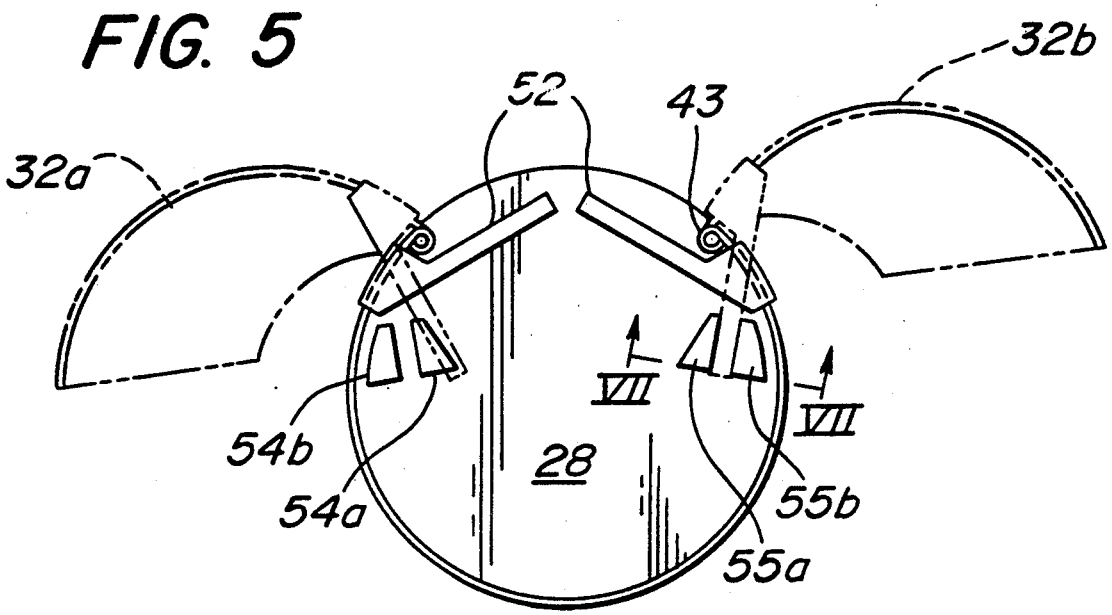
FIG. 5 shows a cross-sectional view of the gliding store taken along lines V—V of FIG. 3.

The gliding stores 10 can be more easily understood by referring to FIGS. 3 through 10. FIGS. 3 and 9 show persepective views of the gliding store 10 immediately after launch from launch container 20 but before detachment of wing release device 24. FIGS. 4 and 10 show views, similar to FIGS. 3 and 9, respectively, but with device 24 pulled away by a launch lanyard 26 to allow wings 32*a,b* to spring open.

Each store 10 is made to have an outward shape of a truncated cone, having a wider, back end 28 and a smaller, front end 30. Each store 10 has its outer shell body and wings 32*a,b* made of any strong, durable and lightweight material such as ABS plastic, and is loaded into launcher 20 sandwiched between disc-shaped sabots 22. Sabots 22 act to buffer the stores 10 during transportation of the launcher and to maintain each store in its relative position inside launcher 20, and prevent movement therein, while the launcher is being transported.

As mentioned above, each store 10 has a wing release device 24 attached to its front end 30, as at knob 36. A launch lanyard 26 of a predetermined length sufficient to allow safe clearance between the transporting aircraft 15 and store 10 before wings 32*a,b* open. As seen in FIGS. 8–10, wing release device 24 can be made from stiffened spring steel wire to take an inverted "V" shape with two main legs 25*a,b*, each ending in an elbow 27*a,b*, respectively (27*a* not seen in FIG. 9. The loops 29 at the top of device 24 are formed into predetermined sizes that allow them to slip-fit and remain over knob 36 and legs 25*a,b* are of sufficient length to place elbows 27*a,b* into a tightly-fitting and containing relationship adjacent the forward edges of wings 32*a,b*.

Figure 6:
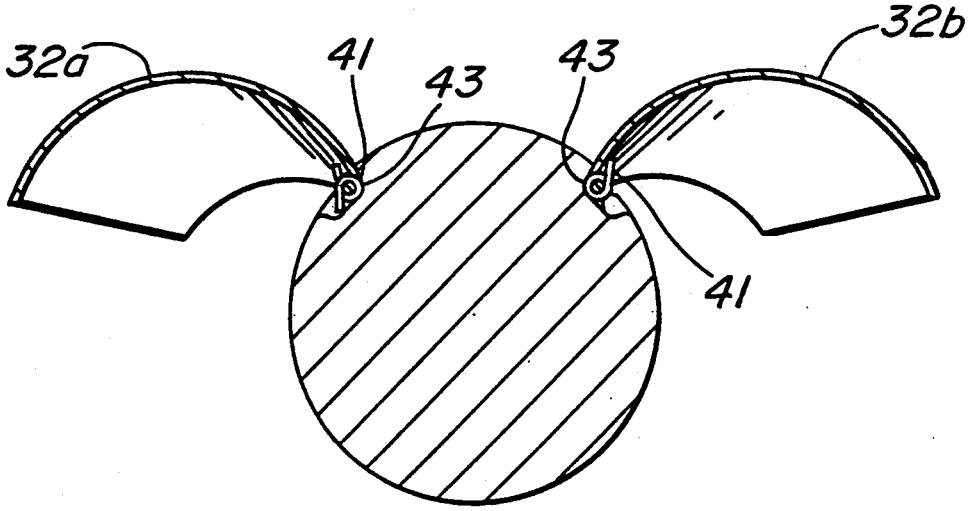
FIG. 6 shows a cross-sectional view of the gliding store taken along lines VI—VI of FIG. 4.

Wings 32*a,b* are made as identical forms to the outer peripheral surface of store 10 and are hinged along predefined, imaginary slant height lines on the surface, as will be explained. Each store body has a slight indentation 43 in the surface skin running from front to back to form a hinge line. Hinge brackets 39*a* are fixedly attached to the outer surface along indentation 43 and hinge brackets 39*b* are formed as part of each wing. At least two expansion-springs 41 are placed in line with each hinge assembly 39 and a hinge pin 39*c* fitted through, as is known. Springs 41 are placed into hinge assembly 39 with end parts extending, as shown in FIG. 6, so that when wings 32*a,b* are closed against the store body, the closing force coils each spring and bias' the spring to an open and uncoiled position.

Each wing carries latching means, in the form of a pawl 52, and the front end holds latch holding means, in the form of a pair of catches 54*a,b* and 55*a,b*, to lock wings 32*a,b* into their opened position. Pawl 52, a rectangular-shaped object, is fastened to the inside leading edge of each wing, as seen in FIGS. 3 and 4, by means of a brace 53 attached, as by fasteners, to the outer surface thereof. In an alternate embodiment, pawl 52 and brace 53 can be molded as one piece for convenience.

Catches 54*a,b* and 55*a,b* and braces 53 are all positioned in a predetermined manner to allow pawls 52 to be firmly caught inbetween piece a and piece b (as seen in FIG. 4) when each wing 32 has opened to its fullest. Catch pieces 54*b* and 55*b* are formed in a triangular shapes with a surface being adjacent apart therefrom pieces 54*a* and 55*a*, as shown, which are quadrilateral shapes of sufficient size larger than pieces 54*b* and 55*b* to form a barrier to prevent further advancement of pawl 52. All catch pieces are fastened to the front end 28 by means known in the art.

OPERATION

Gliding stores 10 are built to have a bias towards a right turn or a left turn as they descend, as seen from the delivery profile shown schematically in FIG. 1. This bias is predetermined by altering the position of one of the hinge lines 43. Alternate stores will have left or right hinges 39 place along this alternate line 43*a* (seen as a temporary line in FIG. 3) to provide less lift for either left or right wing surface. As seen in FIGS. 4 and 10, wings 32*a,b* are shaped as an arc, sometimes referred to as "gull-wings", with a constant thickness throughout. The lift derived from each wing will come from the angle of attack used, in relation to where the center of gravity, $C_a$, is, and by altering a wings hinge line, the symmetry of lift developed by the wings, and therefore the flight path, will be varied. To develop the pattern of FIG. 1, alternate ones of stores 10 are loaded into container 20 to have alternate wing/hinge lines in sequential order.

As each store is ejected from container 20, it will trail the aircraft until reaching the end of launch lanyard 26. The abrupt termination will cause device 24 to be separated, (as seen in FIG. 10), allowing the stored force in springs 43 to push open wings 32. As wings 32 open, pawl 52 slides along front end 28 and onto catch pieces 54*b*, 55*b*. The opening spring force causes each pawl 52 to move into the gap between the catch pieces. As earlier described, differing positions of hinge lines 43 will cause the desired flight path for each store.

Finally, while the gliding stores have been described with reference to a particular embodiment, it should be understood that that embodiment is merely illustrative as there are numerous variations and modifications which may be made by those skilled in the art. Thus, the invention is to be construed as being limited only by the spirit and scope of the appended claims.

What we claim is:

1. A gliding store, that is launched from a launch container at a prespecified velocity and will land at a predetermined destination, comprising:

a store body, being in the shape of a truncated cone, having forward and aft ends of predetermined areas and a slant height of predetermined measurement;

a pair of semi-conically shaped wings hingedly attached along prespecified slant height lines;

biasing means attached to urge said wings from a closed to an open position;

latching means attached to maintain said wings in the open position; and release means attached to releaseably free said wings from a closed position.

2. A gliding store as described in claim 1 wherein said biasing means comprises expansion springs adjacent hinges attaching the wings to the body.

3. A gliding store as described in claim 1 wherein said latching means comprises a pawl fixedly attached to each wing at a prespecified position.

4. A gliding store as described in claim 1 wherein said release means comprises an angled steel wire removeably attached to the forward end.

5. A gliding store as described in claim 1 wherein said latch holding means comprises a pair of catches affixed in a predetermined position to the front end.

6. A gliding store, launchable in to free fall flight from a launch container, comprising a store body in the shape of a truncated cone with a forward end and a larger, back end; a pair of arched wings hingedly fixed along predetermined cone slant height lines and biased to the full open position by expansion springs lodged in the wings; latching pawls affixed to each said wing; a pair of catches affixed onto an end to receive and hold said pawls; and a release clip, attached to a lanyard, releaseably placed onto an end and adjacent each wing.

* * * * *